US009125537B2

(12) United States Patent
Seo

(10) Patent No.: US 9,125,537 B2
(45) Date of Patent: Sep. 8, 2015

(54) UPRIGHT VACUUM CLEANER

(75) Inventor: Ji Won Seo, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 989 days.

(21) Appl. No.: 13/200,366

(22) Filed: Sep. 23, 2011

(65) Prior Publication Data

US 2012/0079679 A1 Apr. 5, 2012

(30) Foreign Application Priority Data

Sep. 30, 2010 (KR) ..... 10-2010-0095035

(51) Int. Cl.
*A47L 9/00* (2006.01)
*A47L 5/28* (2006.01)

(52) U.S. Cl.
CPC .. *A47L 5/28* (2013.01); *A47L 9/009* (2013.01)

(58) Field of Classification Search
CPC ..... A47L 5/28; A47L 9/009
USPC ..... 15/351, 411, 143.1
IPC ..... A47L 9/00
See application file for complete search history.

(56) References Cited

U.S. PATENT DOCUMENTS 5,323,510 A 6/1994 Redding et al.
5,794,305 A 8/1998 Weger
8,667,643 B2 * 3/2014 Simonelli et al. ..... 15/411
2009/0056058 A1 3/2009 Finke et al.
2009/0056059 A1 3/2009 Mersmann et al.

FOREIGN PATENT DOCUMENTS

EP 1 972 855 A1 9/2007
EP 1 956 302 A2 8/2008
GB 2 391 459 A 2/2004
KR 10-2009-0074582 A 7/2009
WO 2004/014209 A1 2/2004

OTHER PUBLICATIONS

Korean Office Action issued May 9, 2012 in corresponding Korean Patent Application 10-2010-0095035.
British Search Report dated Jan. 24, 2012 and issued in corresponding British Patent Application GB116449.8.
European Search Report dated Jan. 31, 2012 in corresponding European Patent Application 11153307.1.

* cited by examiner

*Primary Examiner* — David Redding
(74) *Attorney, Agent, or Firm* — Staas & Halsey LLP

(57) ABSTRACT

An upright vacuum cleaner includes a nozzle assembly, a lower body pivotally connected to the nozzle assembly and provided with an inclination unit on the outer circumferential surface of the lower body, an upper body rotatably connected to the lower body, a bearing member installed between the lower body and the upper body, a steering unit contacting the inclination unit and elastically installed on the upper body, wherein, when the upper body is swiveled with respect to the lower body, the steering unit is moved upwards and downwards by the inclination unit and then applies pressure to the upper body so as to return the upper body to its original position.

13 Claims, 8 Drawing Sheets

UPRIGHT VACUUM CLEANER

CROSS-REFERENCE TO RELATED APPLICATIONS

This application claims the priority benefit of Korean Patent Application No. 2010-0095035, filed on Sep. 30, 2010 in the Korean Intellectual Property Office, the disclosure of which is incorporated herein by reference.

BACKGROUND

1. Field

Embodiments of the present disclosure relate to an upright vacuum cleaner which is easy to change direction and to return a cleaner upper body to its original position.

2. Description of the Related Art

When a surface is cleaned using a vacuum cleaner, the vacuum cleaner needs to be easy to change direction and to return a body which is twisted due to such direction change to its original position for ease of use. Particularly, if a relatively heavy upright vacuum cleaner is used, in order to conveniently and easily operate the vacuum cleaner, the direction of a cleaner nozzle assembly contacting a floor, needs to be easy to change by turning a cleaner handle like a vehicle handle and a cleaner body needs to be easily returned to the center of the nozzle assembly after direction change.

Upright vacuum cleaners which are capable of being tilted and swiveled are disclosed in WO 2004/014209, U.S. Pat. No. 5,794,305, U.S. Pat. No. 5,323,510, US 2009/056058A1 and US 2009/056059A1.

However, the above conventional vacuum cleaners have a complicated structure and thus increase manufacturing costs and repair and maintenance costs. Further, in the conventional vacuum cleaners, an operation of swiveling a cleaner body and an operation of returning the cleaner body to its original position after the swiveling of the cleaner body depend only on force applied by a user, thereby increasing user fatigue and providing inconvenience during use of the cleaner.

SUMMARY

Therefore, it is an aspect of the present disclosure to provide an upright vacuum cleaner which is easy to change direction and to return a cleaner body to its original position after direction change.

It is another aspect of the present disclosure to provide an upright vacuum cleaner which has a simple structure and is convenient to repair and maintain.

Additional aspects of the present disclosure will be set forth in part in the description which follows and, in part, will be apparent from the description, or may be learned by practice of the invention.

In accordance with one aspect of the present disclosure, an upright vacuum cleaner includes a nozzle assembly, a lower body pivotally connected to the nozzle assembly and provided with an inclination unit on the outer circumferential surface of the lower body, an upper body rotatably connected to the lower body, a bearing member installed between the lower body and the upper body, and a steering unit contacting the inclination unit and elastically installed on the upper body, wherein, when the upper body is swiveled with respect to the lower body, the steering unit is moved upwards and downwards by the inclination unit and then applies pressure to the upper body so as to return the upper body to its original position.

The inclination unit may include first, second, and third inclined planes and an inflection part where the first to third inclined planes intersect, the steering unit may contact the inflection part when the upper body is not swiveled, and the steering unit may contact the first inclined plane or the second inclined plane and is swiveled in the same direction as a swiveling direction of the upper body when the upper body is swiveled.

The steering unit may apply pressure to the lower body in the swiveling direction of the upper body, when the upper body is swiveled.

As the lower body is viewed from the front of the cleaner, the first inclined plane, the second inclined plane and the inflection part may be formed in a V shape.

The lower body may include a projection to restrict a swiveling range of the upper body and guide protrusions to guide swiveling of the upper body, and the upper body may include a protruding member, swiveling of which is restricted by the projection, and guide grooves to receive the guide protrusions.

The lower body may include a pipe duct protruded from the upper surface of the lower body and the bearing member may be connected to the pipe duct and received in a bearing receipt part formed on the upper body.

The upper surface of the lower body and the lower surface of the upper body may be inclined so as to have the same inclination angle.

The steering unit may include a body and an elastic member received in the body and stoppers to restrict a vertical movement range of the steering unit may be provided on the body.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
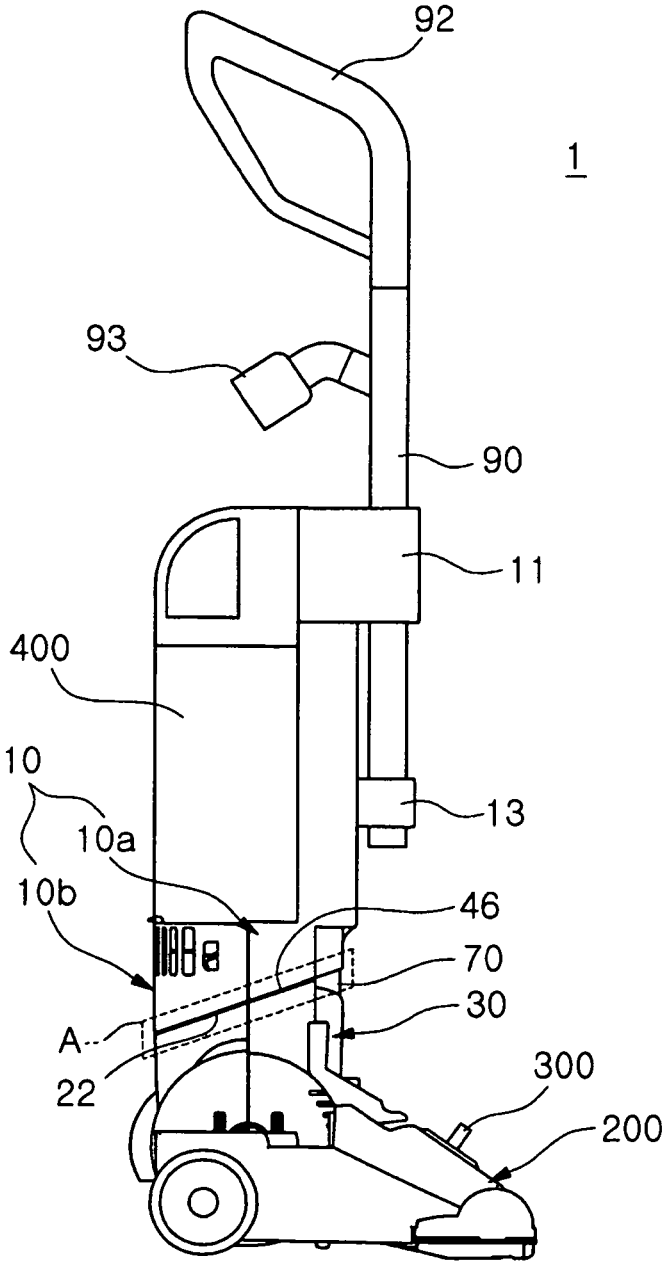
FIG. 1 is a side view illustrating an upright vacuum cleaner in an upright state in accordance with an embodiment of the present disclosure.

Reference will now be made in detail to the embodiments of the present disclosure, examples of which are illustrated in the accompanying drawings, wherein like reference numerals refer to like elements throughout.

Hereinafter, an upright vacuum cleaner 1 in accordance with an embodiment of the present disclosure will be described in detail with reference to the accompanying drawings.

With reference to FIGS. 1 to 4, the upright vacuum cleaner 1 in accordance with the embodiment of the present disclosure includes a nozzle assembly 200, an upper body 10, a lower body 30, a bearing member 60, a steering unit 70 and a dust collecting device 400.

Figure 2:
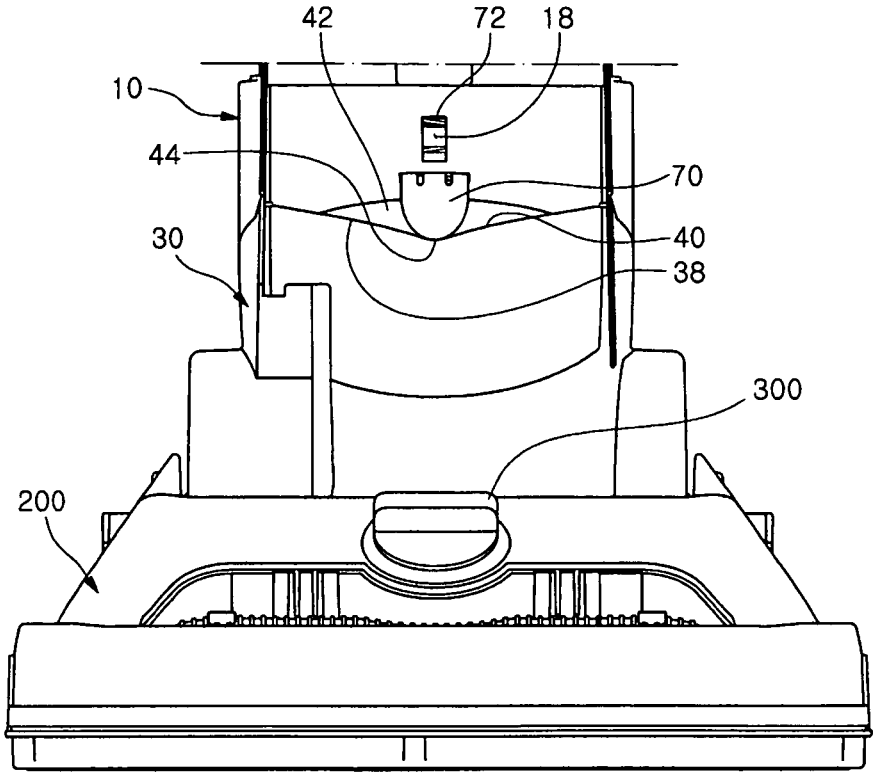
FIG. 2 is a partial front view of the upright vacuum cleaner of FIG. 1.

With reference to FIGS. 1 and 2, the nozzle assembly 200 is connected with the lower body 30 and is provided with a height adjustment lever 300. Further, the nozzle assembly 200 is provided with an air suction hole (not shown) and a rotating brush (not shown). The lower body 30 may be tilted with respect to the nozzle assembly 200.

Figure 5:
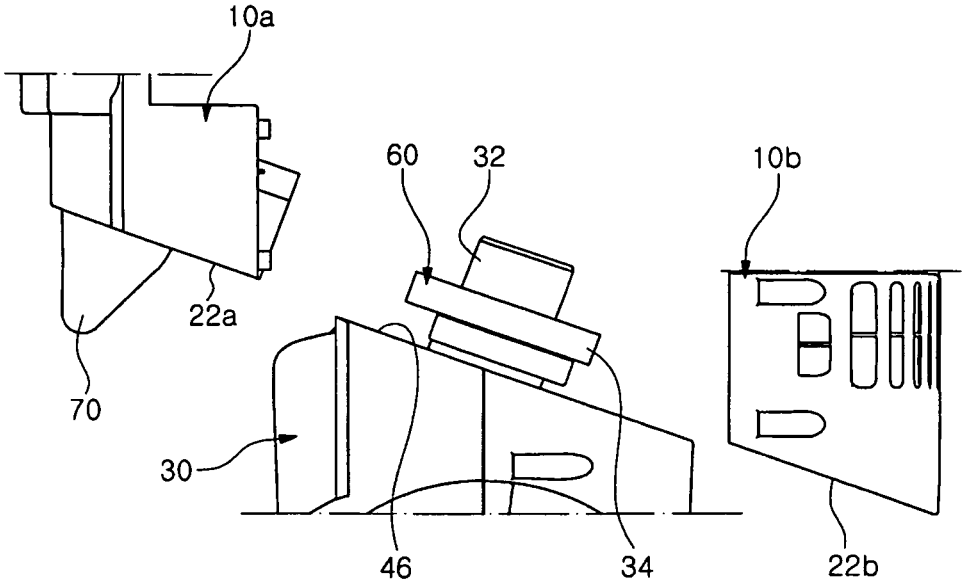
FIG. 5 is a partial exploded perspective view illustrating a portion of the upright vacuum cleaner of FIG. 1.

With reference to FIG. 1, the lower portion of the upper body 10 is connected with the upper portion of the lower body 30 such that the upper body 10 is swiveled leftwards and rightwards with respect to the lower body 30. An extension pipe 90 is detachably fixed to the front surface of the upper body 10, and a handle 92 is formed at the end of the extension pipe 90. With reference to FIGS. 1 and 5, a connection region A between the upper body 10 and the lower body 30 is inclined such that the front portion of the connection region A is high and the rear portion of the connection region A is low. A lower surface 22 of the upper body 10 is inclined downwards from the front portion to the rear portion of the cleaner so as to have the same inclination angle as that of an upper surface 46 of the lower body 30. With reference to FIG. 5, the upper body 10 is divided into an upper body front part 10*a* and an upper body rear part 10*b*. A lower surface 22*a* of the upper body front part 10*a* is higher than a lower surface 22*b* of the upper body rear part 10*b*. With reference to FIG. 2, a steering unit receipt part 18 on which the steering unit 70 is mounted is formed on the lower portion of the front surface of the upper body 10, and with reference to FIG. 3, a bearing receipt part 14 to receive the bearing member 60 and a projection 34 of the lower body 30 is formed at the center of the lower portion of the upper body 10. The dust collecting device 400 to collect dust and filters (not shown) are installed on the upper body 10. Although not shown in FIG. 1, reference numeral 93 represents a host connection part and reference numerals 11 and 13 represent support parts to separably fix the extension pipe 90 to the upper body 10. Although not shown in the drawings, a hose is connected to the hose connection part 93 and the dust collecting device 400, as in conventional upright vacuum cleaners.

Figure 3:
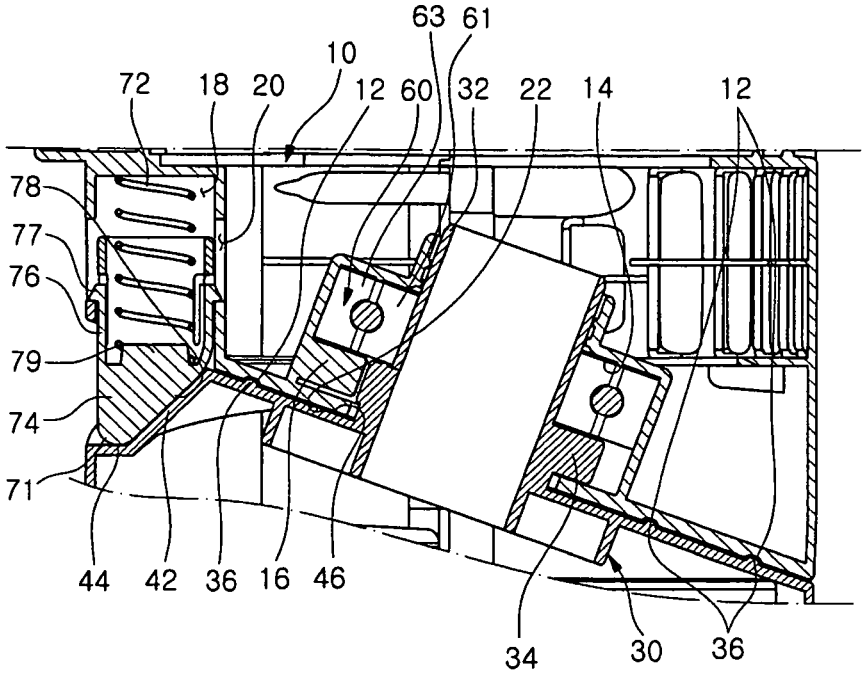
FIG. 3 is a partial cross-sectional view of the upright vacuum cleaner of FIG. 1.
Figure 4:
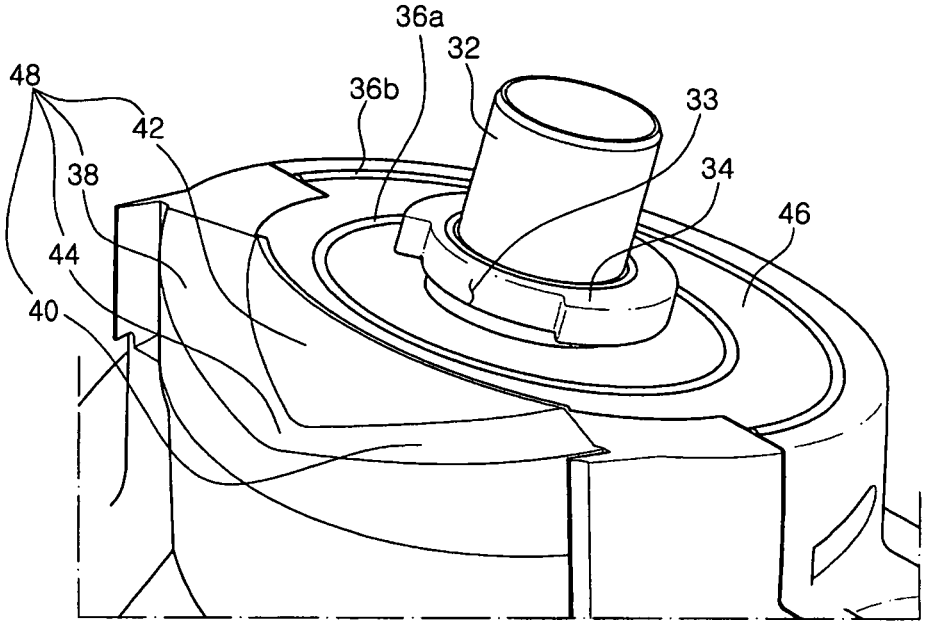
FIG. 4 is a perspective view illustrating a portion of a lower body of the upright vacuum cleaner of FIG. 1.

With reference to FIGS. 1 to 5, the upper end of the lower body 30 is rotatably connected to the upper body 10 and the lower end of the lower body 30 is pivotally connected to the nozzle assembly 200. With reference to FIGS. 3 to 5, the upper surface 46 of the lower body 30 is inclined so as to have the same inclination as that of the lower surface 22 of the upper body 10, and a pipe duct 32 is protruded integrally from the center of the lower body 30. The bearing member 60 is fixed to the outer circumferential surface of the pipe duct 32 by interference fit, and the projection 34 is protruded between the bearing member 60 and the upper surface 46 of the lower body 30. With reference to FIG. 4, the projection 34 is protruded in the circumferential direction of the pipe duct 32 except for a rotation space 33 in which a protruding member 16 (with reference to FIG. 3) provided on the upper body 10 is rotated. With reference to FIGS. 3 and 4, two guide protrusions 36*a* and 36*b* (together as the guide protrusions 36) are provided on the upper surface 46 of the lower body 30. The first guide protrusion 36*a* having a small diameter is protruded in a ring shape, the circumference of which forms a 360 degree arc, and the second guide protrusion 36*b* having a large diameter is protruded in a half ring shape, the circumference of which forms an about 180 degree arc. The two guide protrusions 36*a* and 36*b* are received in guide grooves 12 formed on the lower surface 22 of the upper body 10, thereby guiding swiveling of the upper body 10 when the upper body 10 is swiveled with respect to the lower body 30. With reference to FIG. 4, an inclination unit 48 is formed on the upper portion of the front surface of the lower body 30. The inclination unit 48 includes first, second, and third inclined planes 38, 40 and 42 and an inflection part 44. As viewed from the front of the cleaner, the first inclined plane 38, the inflection part 44 and the second inclined plane 40 are formed in a V shape (with reference to FIG. 2). The first inclined plane 38 and the second inclined plane 40 have the same inclination angle, and the first to third inclined planes 38, 40 and 42 intersect at the inflection part 44. Therefore, when the upper body 10 is not swiveled, the steering unit 70 contacts the inflection part 44, as shown in FIG. 2.

With reference to FIGS. 3 and 5, an inner race 61 of the bearing member 60 is fixed to the outer circumferential surface of the pipe duct 32, and an outer race 63 of the bearing member 60 is fixed to the inner surface of the bearing receipt part 14 of the upper body 10. Therefore, the upper body 10 may be conveniently swiveled with respect to the lower body 30 without friction.

Figure 6:
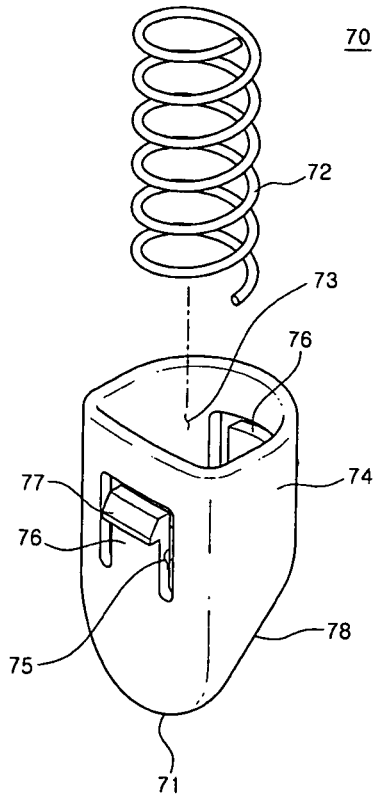
FIG. 6 is an enlarged exploded perspective view of a steering unit installed in the upright vacuum cleaner of FIG. 1.

With reference to FIG. 6, the steering unit 70 includes a body 74 and an elastic member 72. The lower surface of the body 74 includes a body inclined plane 78 and a convex part 71. The body inclined plane 78 has the same inclination angle as that of the third inclined plane 42 of the lower body 30, and the convex part 71 has the same curvature as that of the inflection part 44 of the lower body 30. Stoppers 76, each of which is provided with a hook 77, are provided on both side surfaces of the body 74. Further, cutting parts 75 are formed on the body 74 such that the stoppers 76 may elastically move. The steering unit 70 is detached from and mounted in the steering unit receipt part 18 (with reference to FIGS. 2 and 3) of the upper body 10. With reference to FIG. 3, the elastic member 72 is mounted in and detached from an elastic member receipt part 73 of the body 74, one end of the elastic member 72 is fixed to a support protrusion 79, and the other end of the elastic member 72 is supported by the upper body 10. The hooks 77 are installed so as to be latched to an opening formed in the steering unit receipt part 18, and the steering unit 70 moves vertically within the opening 20.

The dust collecting device 400 may be mounted on and detached from the upper body 10, and removes dust from external air selectively introduced through the nozzle assembly 200 or the extension pipe 90. Constitution of the dust collecting device 400 is not within the scope of the present disclosure and thus a detailed description thereof will be omitted.

Hereinafter, with reference to the accompanying drawings, a direction changing operation of the upright vacuum cleaner 1 in accordance with the embodiment of the present disclosure will be described in detail.

If the upright vacuum cleaner 1 is positioned upright, as shown in FIG. 1, the steering unit 70 is positioned upright under the condition that it contacts the inflection part 44 and the third inclined plane 42, as shown in FIGS. 2 and 3.

Figure 7:
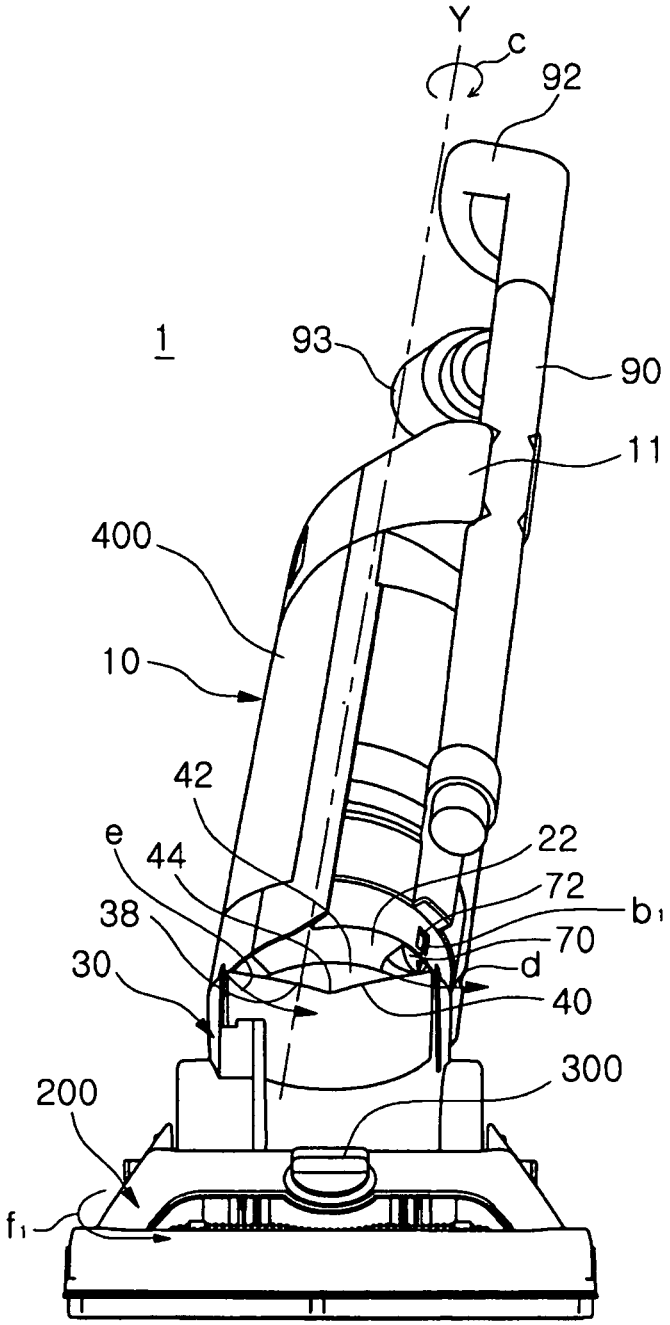
FIG. 7 is a perspective view illustrating a leftward swiveling operation of the upright vacuum cleaner of FIG. 1.

As shown in FIG. 7, when a user tilts the upper and lower bodies 10 and 30 and then swivels the upper body 10 leftwards through the handle 92 (with reference to the arrow c of FIG. 7), the upper body 10 is swiveled leftwards under the guidance of the guide protrusions 36*a* and 36*b* and the guide grooves 12 (with reference to FIG. 3). Here, the steering unit 70 moves leftwards along the second inclined plane 40 and the third inclined plane 42 and applies pressure to the lower body 30 in the leftward direction (with reference to the arrow d of FIG. 7), and the elastic member 72 in the steering unit receipt part 18 is constricted. Further, since the lower surface 22 of the upper body 10 and the upper surface 46 of the lower body 30 are inclined, the upper body 10 is swiveled with respect to the lower body 30 and the lower surface 22*b* (with reference to FIG. 5) of the upper body rear part 10*b* having a low height is swiveled along the guide protrusions 36*a* and 36*b* of the lower body 30 and applies pressure to the right portion of the upper surface 46 of the lower body 30 having a high height (with reference to the arrow e of FIG. 7). When the steering unit 70 and the inclined lower surface 22*b* of the upper body 10 apply pressure to the lower body 30 in the leftward direction, the direction of the nozzle assembly 200 connected with the lower body 30 is naturally changed leftwards (with reference to the arrow f1 of FIG. 7).

When the direction of the nozzle assembly 200 is changed leftwards, the steering unit 70 is returned to its original position along the second inclined plane 40 and the third inclined plane 42 due to the elastic force supplied by the constricted elastic member 72. That is, the steering unit 70 descends along the second inclined plane 40 due to force applied by the elastic member 72 downwards to the body 74 (with reference to the arrow b1 of FIG. 7) and then is stopped at the inflection part 44. Thereby, the upper body 10 is returned to its original position, i.e., the center of the upright vacuum cleaner 1, as shown in FIG. 2. Therefore, a user may return the upper body 10 to its original position without having to apply any considerable force.

Figure 8:
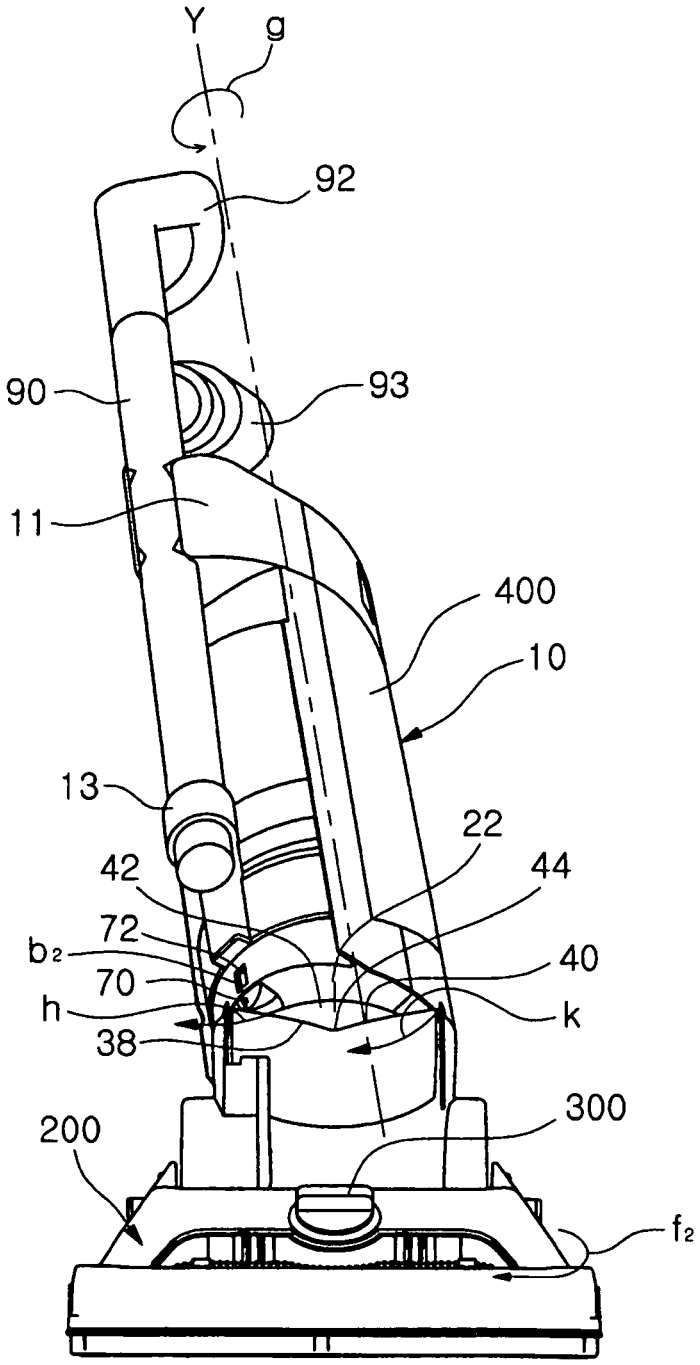
FIG. 8 is a perspective view illustrating a rightward swiveling operation of the upright vacuum cleaner of FIG. 1.

As shown in FIG. 8, when a user swivels the upper body 10 rightwards with respect to the lower body 30 (with reference to the arrow g of FIG. 8), the steering unit 70 moves rightwards along the first inclined plane 38 and the third inclined plane 42 and ascends, and the elastic member 72 is constricted. The steering unit 70 moves rightwards and applies pressure to the lower body 30 in the rightward direction (with reference to the arrow h of FIG. 8), and the upper body rear part 10*b* (with reference to FIG. 5) is swiveled and applies pressure to the upper surface 46 of the lower body 30 in the rightward direction (with reference to the arrow k of FIG. 8). Thereby, the nozzle assembly 200 is swiveled rightwards due to force shown by the arrow f2 of FIG. 8. When the user removes force applied to the handle 92 after changing the direction of the cleaner rightwards, the steering unit 70 is returned to its original position along the first inclined plane 38 and the third inclined plane 42 due to the elastic force (with reference to the arrow b2 of FIG. 8) of the elastic member 72 and is thus is located at the inflection part 44. Thereby, the upper body 10 is returned to its original position, i.e., the center of the upright vacuum cleaner 1.

As described above, the steering unit 70 tends to be returned to the position of the inflection part 44 along the first to third inclined planes 38, 40 and 42 by the elastic member 72 at any time. That is, the upper body 10 and the lower body 30 tend to maintain a state in which the central portions of the upper and lower bodies 10 and 30 are arranged and a state in which the upper and lower bodies 10 and 30 is positioned upright. In order to return the upright vacuum cleaner 1 to the upright position, when a user erects the tilted lower body 30 and releases the handle 92, the steering unit 70 moves to the inflection part 44 along the first to third inclined planes 38, 40 and 42 and thus the upright vacuum cleaner 1 is naturally returned to the upright position, as shown in FIG. 1.

Therefore, the user not only easily changes the direction of the upright vacuum cleaner 1 but also easily returns the upper body 10 to its original position only by removing force applied to the handle 92 after such direction change. Further, the upright vacuum cleaner 1 has a simple structure and is easy to repair and maintain as compared with conventional upright vacuum cleaners.

As is apparent from the above description, an upright vacuum cleaner in accordance with one embodiment of the present disclosure is easy to change direction and to return an upper body to its original position after direction change, thereby reducing user fatigue and improving operability of the cleaner and convenience in use of the cleaner.

Further, the upright vacuum cleaner in accordance with the embodiment of the present disclosure has a simple structure and a small number of parts, thereby reducing manufacturing costs and being easy to repair and maintain.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An upright vacuum cleaner comprising:

a nozzle assembly;

a lower body pivotally connected to the nozzle assembly and provided with an inclination unit on the outer circumferential surface of the lower body;

an upper body rotatably connected to the lower body;

a bearing member installed between the lower body and the upper body; and a steering unit contacting the inclination unit and elastically installed on the upper body, wherein, when the upper body is swiveled with respect to the lower body, the steering unit is moved upwards and downwards by the inclination unit and then applies pressure to the upper body so as to return the upper body to its original position.

2. The upright vacuum cleaner according to claim 1, wherein:

the inclination unit includes first, second, and third inclined planes and an inflection part where the first to third inclined planes intersect; and the steering unit contacts the inflection part when the upper body is not swiveled, and the steering unit contacts the first inclined plane or the second inclined plane and is swiveled in the same direction as a swiveling direction of the upper body when the upper body is swiveled.

3. The upright vacuum cleaner according to claim 2, wherein the steering unit applies pressure to the lower body in the swiveling direction of the upper body, when the upper body is swiveled.

4. The upright vacuum cleaner according to claim 2, wherein, as the lower body is viewed from the front of the cleaner, the first inclined plane, the second inclined plane and the inflection part are formed in a V shape.

5. The upright vacuum cleaner according to claim 1, wherein:

the lower body includes a projection to restrict a swiveling range of the upper body, and guide protrusions to guide swiveling of the upper body; and the upper body includes a protruding member, swiveling of which is restricted by the projection, and guide grooves to receive the guide protrusions.

6. The upright vacuum cleaner according to claim 1, wherein:

the lower body includes a pipe duct protruded from the upper surface of the lower body; and the bearing member is connected to the pipe duct and received in a bearing receipt part formed on the upper body.

7. The upright vacuum cleaner according to claim 1, wherein the upper surface of the lower body and the lower surface of the upper body are inclined so as to have the same inclination angle.

8. The upright vacuum cleaner according to claim 1, wherein:

the steering unit includes a body and an elastic member received in the body; and stoppers to restrict a vertical movement range of the steering unit are provided on the body.

9. The upright vacuum cleaner according to claim 1, wherein the upper body is divided into an upper body front part and an upper body rear part, and the lower surface of the upper body front part is higher than a lower surface of the upper body rear part.

10. The upright vacuum cleaner according to claim 5, wherein the guide protrusions includes first and second guide protrusions, the first guide protrusion is protruded in a ring shape, and the second guide protrusion is protruded in a half ring shape, and the diameter of the first guide protrusion is smaller than the diameter of the second guide protrusion.

11. The upright vacuum cleaner according to claim 2, wherein the first inclined plane and the second inclined plane have the same inclination angle.

12. The upright vacuum cleaner according to claim 6, wherein the bearing member includes an inner race fixed to the outer circumferential surface of the pipe duct, and an outer race fixed to the inner surface of the bearing receipt part of the upper body.

13. The upright vacuum cleaner according to claim 2, wherein the steering unit includes a body and an elastic member received in the body and stoppers to restrict a vertical movement range of the steering unit are provided on the body, the body of the steering unit includes a body inclined plane having the same inclination angle as that of the third inclined plane of the lower body and a convex part having the same curvature as that of the inflection part of the lower body, and the stoppers includes a hook so as to be latched to an opening formed in the steering unit receipt part, and the steering unit moves vertically within the opening.

* * * * *